US007025479B2

(12) United States Patent
Wardenburg

(10) Patent No.: US 7,025,479 B2
(45) Date of Patent: Apr. 11, 2006

(54) ADJUSTABLE REFLECTOR SOCKET

(75) Inventor: Peter B. Wardenburg, Novato, CA (US)

(73) Assignee: Hydrofarm, Inc., Petaluma, CA (US)

( * ) Notice: Subject to any disclaimer, the term of this patent is extended or adjusted under 35 U.S.C. 154(b) by 144 days.

(21) Appl. No.: 10/656,958

(22) Filed: Sep. 8, 2003

(65) Prior Publication Data

US 2005/0052867 A1 Mar. 10, 2005

(51) Int. Cl.
*F21V 21/10* (2006.01)

(52) U.S. Cl. ..... 362/429; 362/430; 362/372; 362/285

(58) Field of Classification Search ..... 362/267, 362/319, 429, 232, 226, 285, 425, 508, 289, 362/449, 372; 313/318.01–318.12
See application file for complete search history.

(56) References Cited

U.S. PATENT DOCUMENTS 1,054,746 A * 3/1913 Christian ..... 362/285
5,722,770 A * 3/1998 Douglas ..... 362/285
5,791,768 A * 8/1998 Splane, Jr. ..... 362/280
6,273,590 B1 * 8/2001 Splane, Jr. ..... 362/304
6,464,377 B1 * 10/2002 Splane, Jr. ..... 362/296

* cited by examiner

*Primary Examiner*—Sandra O'Shea
*Assistant Examiner*—Robert J May
(74) *Attorney, Agent, or Firm*—Kremblas, Foster, Phillips & Pollick

(57) ABSTRACT

An adjustable reflector socket is provided having a bulb socket, a mounting member and a mounting plate. The mounting member has an exterior sidewall, a first end having an end plate, and a second end adjacent to the bulb socket. The sidewall has at least one groove formed therein, with the groove having a plurality of apertures formed therein. The mounting plate preferably has a planar component with at least one mounting aperture through which a fastener passes to attach the plate to the lighting reflector, and a mounting member aperture configured to permit the mounting member to be inserted therethrough. The plate also has at least one flange member extending generally perpendicularly from the juncture of the plate and the mounting member aperture, with the flange member dimensioned to be slidably adapted in the sidewall groove, and with it having formed therein at least one flange aperture. A flange fastener at the flange aperture secures the flange member to the mounting member at one of the apertures formed in the groove. A method for adjusting the socket in actual use is also disclosed.

15 Claims, 12 Drawing Sheets

ADJUSTABLE REFLECTOR SOCKET

BACKGROUND OF THE INVENTION

1. Field of the Invention

The present invention relates generally to a light socket, and more particularly to an adjustable light socket, and even more particularly to an adjustable reflector light socket for use with reflectors commonly used in conjunction with the growing of plants indoors.

2. Description of the Related Art

This invention is directed to the providing of an adjustable light socket for use with reflectors of the type commonly used to grow plants indoors. One of the greatest challenges to commercial greenhouses and hobby gardeners is providing their plants with enough light. Light affects the longevity and health of plants, as well as playing a key role in flowering and fruiting. That is because light is essential for photosynthesis, which is the process whereby light energy is used to convert water and carbon dioxide to sugar and other carbohydrates useful to plants.

Not only is the presence of light important to plants, but the actual color of light has been found to be important. For example, leaves reflect energy from yellow and green rays of light, while the red and blue parts of the light spectrum are very important energy sources for plants. Natural light provides plants with sufficient levels of red and blue light rays. However, if plants are grown indoors whether the reason is due to commercial greenhouse considerations, aesthetics, time of year, or to temperature, additional light from artificial sources such as a light system normally must be provided.

The properties of light which need to be considered in the choice of a light system are duration, intensity, and quality. Duration concerns the hours of light per day to which plants are exposed. Most plants need a significant amount of light. Intensity refers to the foot-candles of light that shine on a particular plant. On a sunny day, the light intensity may be several thousand foot-candles, whereas an indoor light level may be less than a couple of hundred foot-candles. Quality refers to the color of the light rays which originate from a light source as discussed above.

While the most common type of artificial light sources in homes are incandescent bulbs, this type of bulb is not particularly good for maximizing plant growth because they lack intensity, they do not emit enough blue rays, and they produce too much heat when compared to other bulbs. Finally, they typically do not last as long as some other types of bulbs, and are thus not cost effective. Another type of bulb, fluorescents, has good spectral qualities, but lack intensity.

Among the most effective and brightest lights currently available are high intensity discharge (HID) lamps. This type of bulb creates light by passing electricity through a sealed glass or ceramic tube. The two most common types of HID bulbs are called metal halide and high pressure sodium, referred to as halide and sodium respectively. Halide bulbs are the most popular source of white light available for indoor horticultural use. The bulbs produce light several times as efficiently as fluorescent tubes and incandescent bulbs. Plants also appear very favorably under this light. On the other hand, sodium bulbs are the brightest type of HID lamps. In addition to lasting longer than halide bulbs, they emit more red rays of light. Sodium bulbs are commonly used in greenhouses to supplement natural light.

Choice of the correct type of bulb is not the only factor to be considered in an artificial lighting system for growing plants. To maximize the amount of light which can be made to fall on a particular plant or group of plants, reflectors are used. Reflectors do exactly what the name implies, namely, reflect light. In one sense, reflectors are one of the most important parts of a light system, since they determine the amount of light reflected upon the plants as well as how uniform the light is. However, just picking the desired bulb and a quality reflector does not in and of itself maximize the emitted light. This is because the various types of light bulbs all have their own specific focal point. Thus, by way of example, halide bulbs have a different focal point associated with them than do sodium bulbs.

Therefore, to get the maximum light reflected, it helps to have a bulb exactly positioned within the reflector to take into account the bulb's specific pattern of emitted light. Consequently, to obtain the maximum light from some bulbs, they need to be positioned further into the reflector than do certain other bulbs. Conversely, to obtain the maximum light from other bulbs, they need to be positioned closer to the side wall of the reflector.

Other important components of lighting systems may include light timers, transformers, capacitors, ballasts, and power cords. However, the type of bulb and the maximization of the available light are extremely important. Recognizing the importance of bulb type and positioning, grow lights have typically been sold in conjunction with a reflector socket that can be fixedly secured to a reflector if desired, and, which when secured, maximizes that particular type of bulb's emitted light by positioning its focal point within the reflector.

Recognition of the problem of lamp placement has resulted in several attempts to address the problem. One attempted solution has been to provide a spacer of varying lengths that can be secured intermediate the socket and the junction box which is attached to the reflector frame. However, each time one type of bulb is changed to a different type of bulb, the spacer must be removed from the fixture, and a new spacer specifically designed for the different type of bulb inserted, which also requires that the electrical connection be re-wired to accommodate the new spacer. This system also requires that the spacer adapter be stored someplace, just in case the newly installed bulb is later replaced with the prior type of bulb. This entire process involves the additional cost of new spacers, the cost and spatial aspect of storage, and the time in the switching and storing of spacers.

It is thus apparent that the need exists for an adjustable reflector light socket that can be used in conjunction with reflectors used indoors, and is especially adaptable to multiple types of bulbs while still being able to obtain maximum emitted light.

SUMMARY OF THE INVENTION

In accordance with this invention, there is disclosed an adjustable reflector socket for use in conjunction with a lighting reflector and light bulb, with the adjustable socket having a bulb socket, a mounting member and a mounting plate. The mounting member has an exterior sidewall, a first end having an end plate through which an electrical cord passes, and a second end adjacent to the bulb socket. The sidewall has at least one groove formed therein, with the sidewall groove having a plurality of apertures formed therein. The mounting plate preferably has a planar component having at least one mounting aperture through which a mounting fastener passes to attach the mounting plate to the lighting reflector, and a centrally located mounting member aperture configured to permit the mounting member to be inserted therethrough. The mounting plate also has at least one flange member extending generally perpendicularly from the juncture of the mounting plate and the mounting member aperture, with the flange member dimensioned to be slidably adapted in the sidewall groove, and with the flange member having formed therein at least one flange aperture. A flange fastener at the flange aperture secures the flange member to the mounting member at one of the apertures formed in the groove of the mounting member.

At least a portion of the end plate is detachable from the mounting member for the purpose of making electrical connections. The mounting member preferably comprises a pair of grooves. In the preferred embodiment of the invention, each of the grooves is located on opposite sides of the mounting member. The mounting plate preferably has two flanges, each of which is engaged in the grooves. The flanges are preferably located on opposite sides of the mounting plate. Each flange preferably has more than one flange aperture formed therein. The groove extends from the first end to the second end of the mounting member.

The mounting plate has a mounting aperture in the same plane as the groove, and another mounting aperture in the form of a slot, with the mounting plate having a peripheral edge, and with the slot extending centrally from the peripheral edge. The groove has a width and a depth as well as the flange, with the groove width being greater than the flange width, and with the groove depth being approximately the same as the flange depth. In the preferred embodiment of the invention, each groove has four apertures formed therein, and each flange has two apertures formed therein.

The flange fastener is positioned into a predetermined aperture in the groove and into a predetermined aperture in the flange depending upon the choice of lighting reflector and the light bulb, with the flange fastener securing the mounting plate to the mounting member, thereby locating the bulb in the optimized position relative to the reflector.

There is also disclosed a method for obtaining the maximum emitted light from a bulb in the growing of plants through the use of a lighting reflector having an adjustable reflector light socket comprising the steps of securing a mounting plate to the sidewall of a lighting reflector, inserting a mounting member through the mounting member aperture in the mounting plate, with the mounting member having at least one groove formed therein with a bulb socket being secured to one end of the mounting member, and securing the mounting member to the mounting plate at a predetermined location on the mounting member dependant on the type of bulb and type of lighting reflector being used. The mounting plate has a centrally located mounting member aperture, with mounting member aperture configured to permit the mounting member to be inserted therethrough. The mounting plate also has at least one flange member extending generally perpendicularly from the juncture of the mounting plate and the mounting member aperture.

The flange member is dimensioned to be slidably adapted in the mounting member groove, with the flange member having formed therein a plurality of flange apertures, and with the groove having formed therein a plurality of groove apertures, such that the method includes the additional step of selecting the flange aperture and groove aperture for attachment thereat of a flange fastener, so that the flange fastener secures the flange member to the mounting member at a location to maximize the emitted light given the choice of the bulb and the lighting reflector.

The primary objective of this invention is to provide a reflector light socket which is adjustable with respect to the bulb and the reflector with which it is used, such that it can be used in conjunction with a variety of light bulbs to provide a highly effective level of light.

Another objective is to provide a reflector light socket which is easily adjustable. An important aspect of this objective is the providing of a unique mounting disc which can easily be secured to a reflector, and which then provides for the easy securing thereto of the desired socket means.

Yet still another objective is to provide a reflector light socket which is relatively simple to manufacture.

Other objects and advantages of the invention will be apparent from the following description, the accompanying drawings, and the appended claims.

Figure 1:
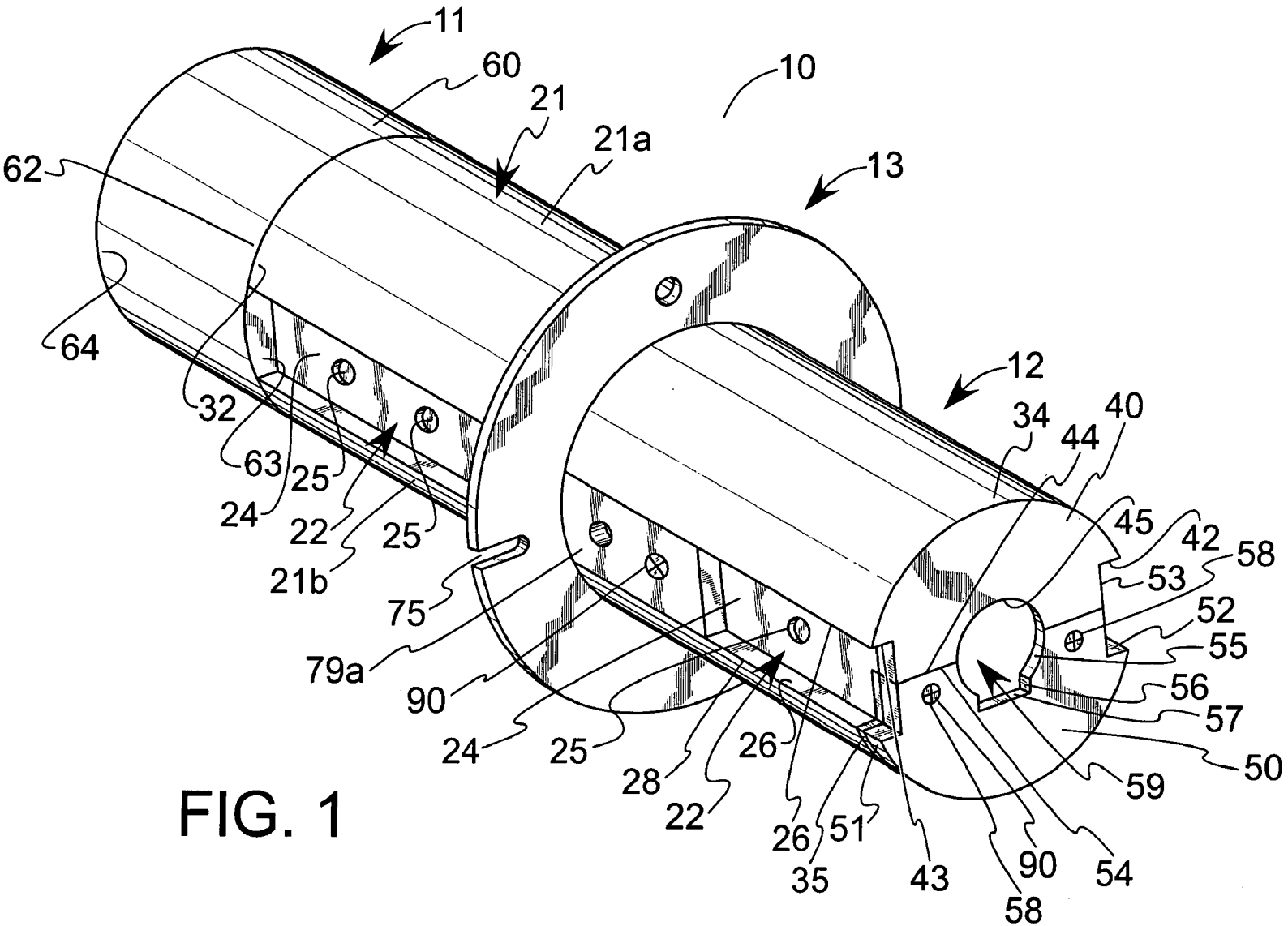
FIG. 1 is a perspective view of a reflector light socket made in accordance with the present invention.
Figure 2:
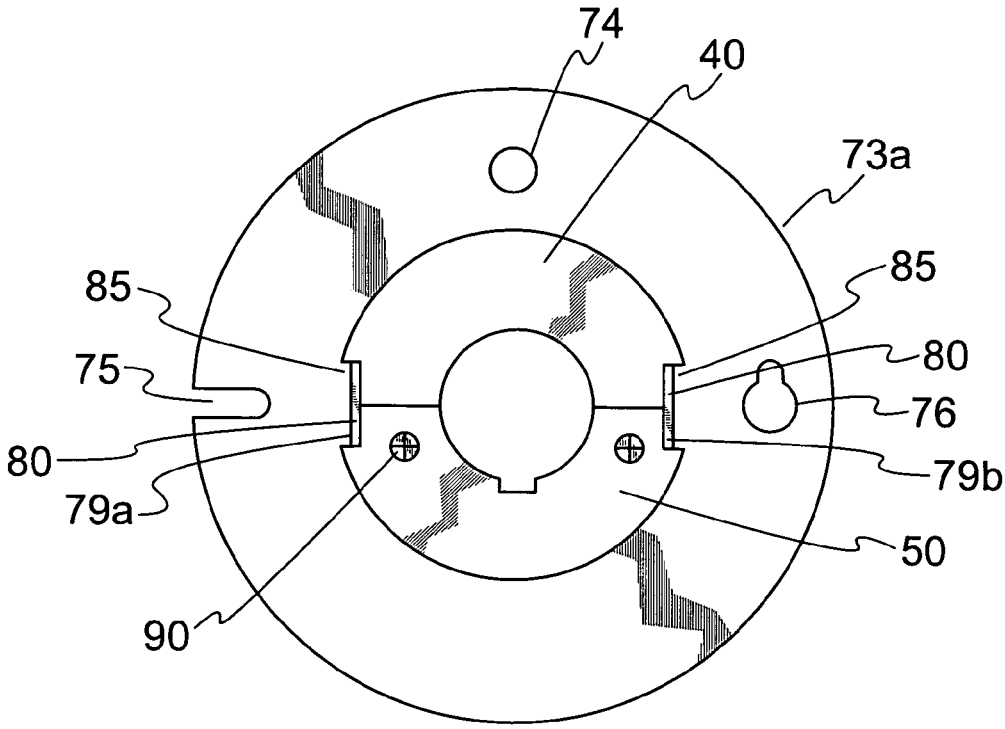
FIG. 2 is a front elevational view taken from the right side of FIG. 1.
Figure 3:
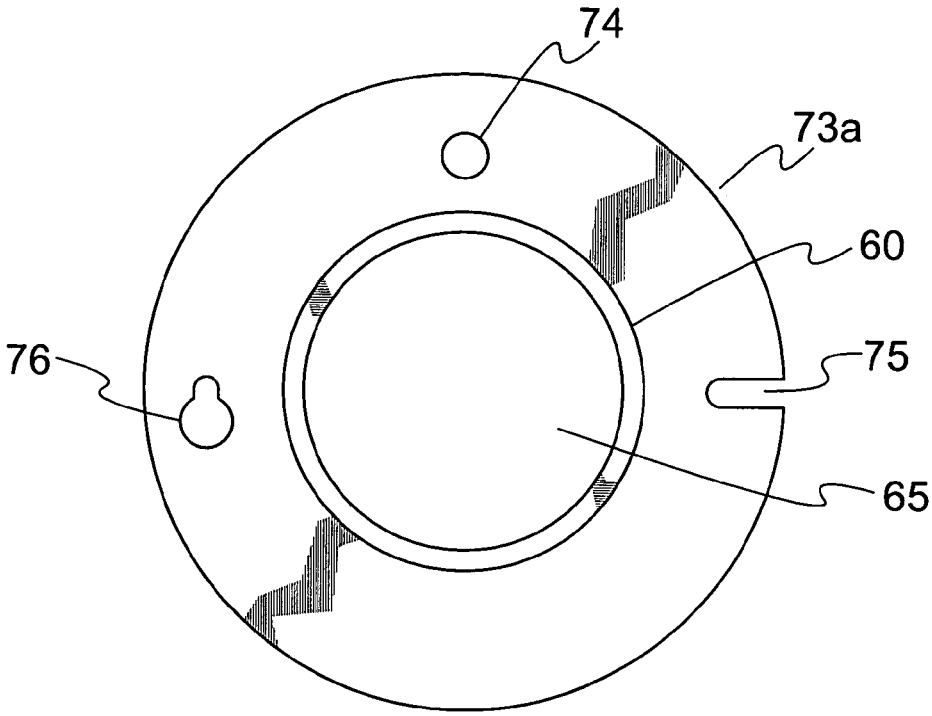
FIG. 3 is a rear elevational view taken from the left side of FIG. 1.
Figure 4:
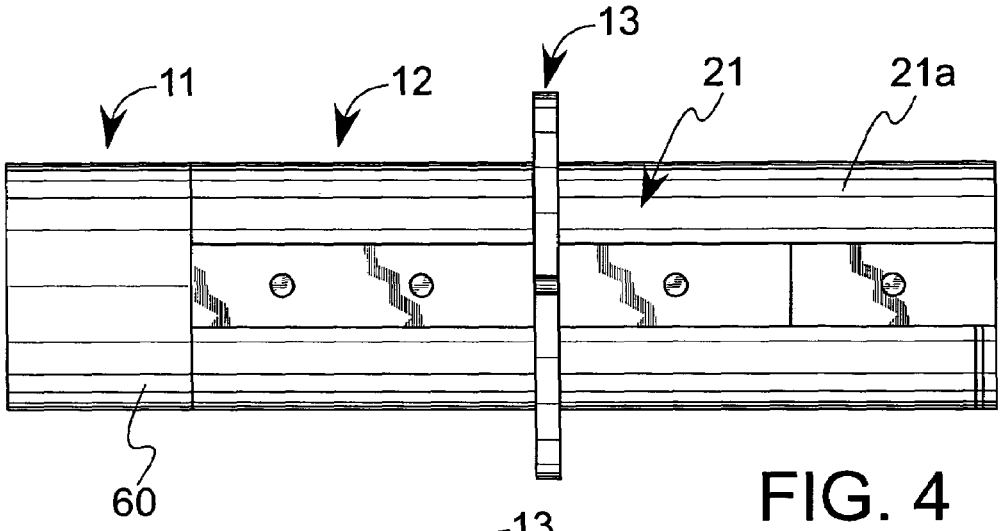
FIG. 4 is a left side elevational view.
Figure 5:
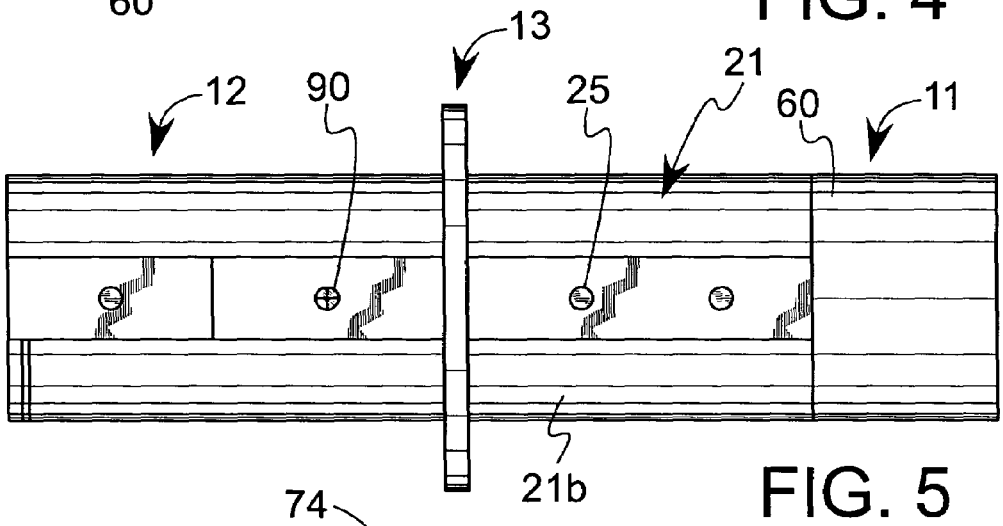
FIG. 5 is a right side elevational view.
Figure 9:
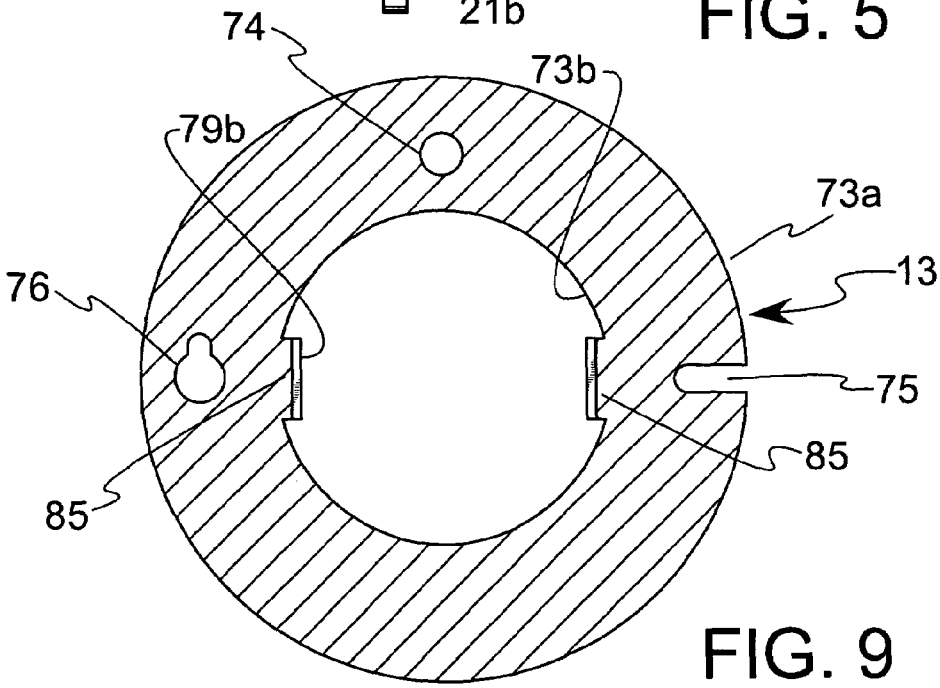
FIG. 9 is a vertical sectional view taken along line 9—9 of FIG. 8.
Figure 6:
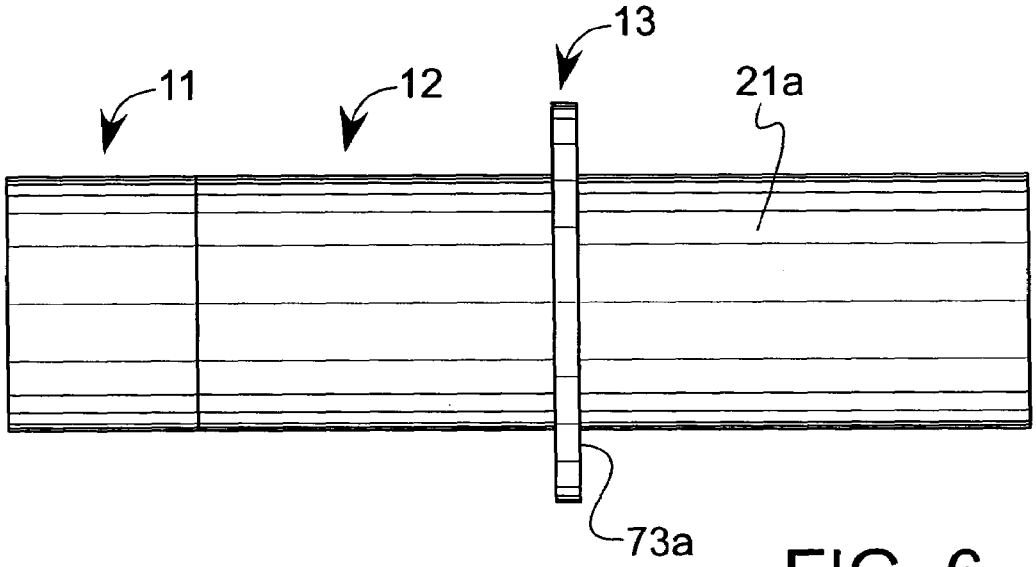
FIG. 6 is a top plan view.
Figure 7:
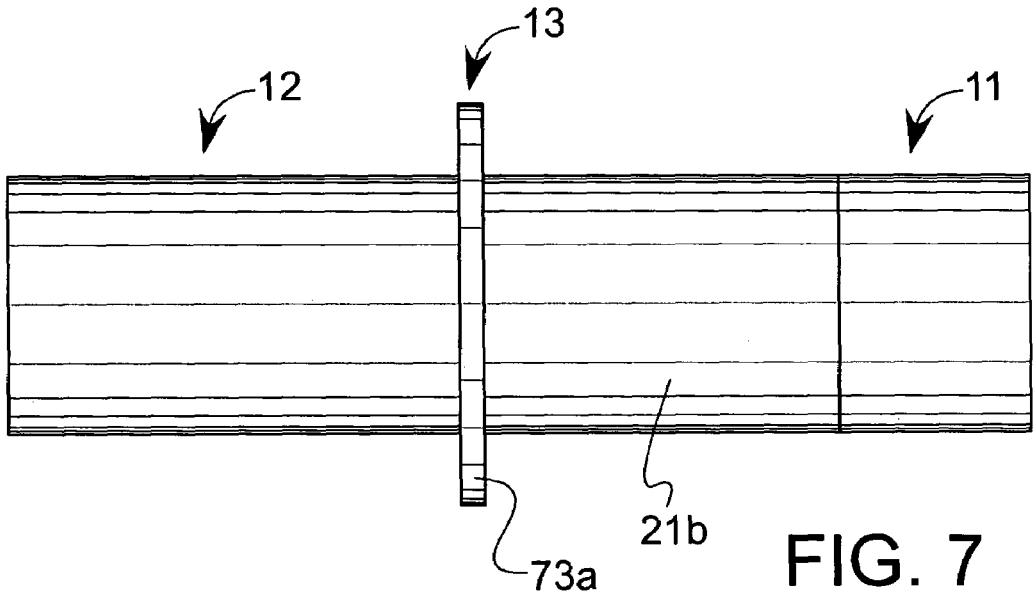
FIG. 7 is a bottom plan view.
Figure 8:
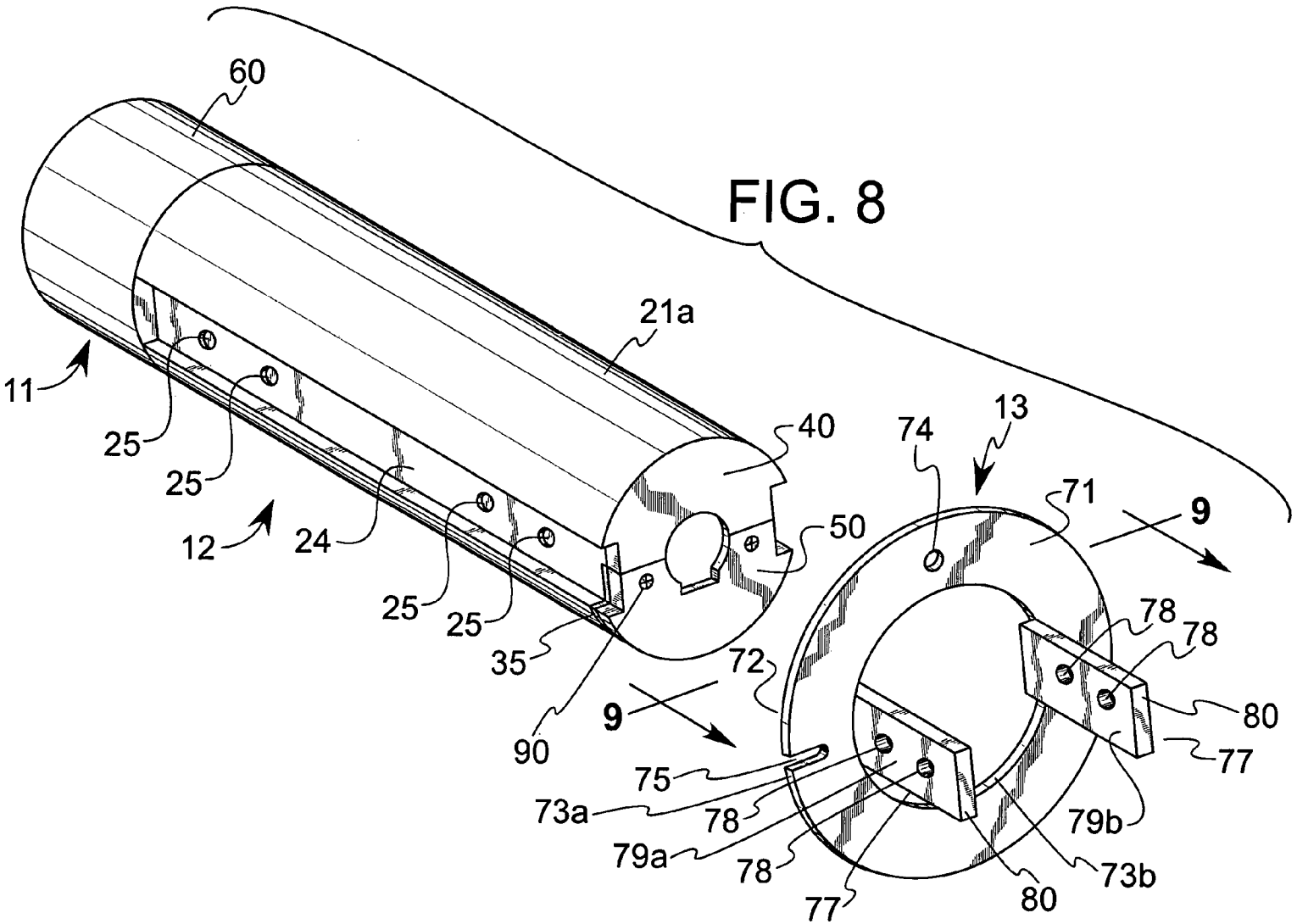
FIG. 8 is an exploded perspective view taken of the invention shown in FIG. 1.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Figure 10:
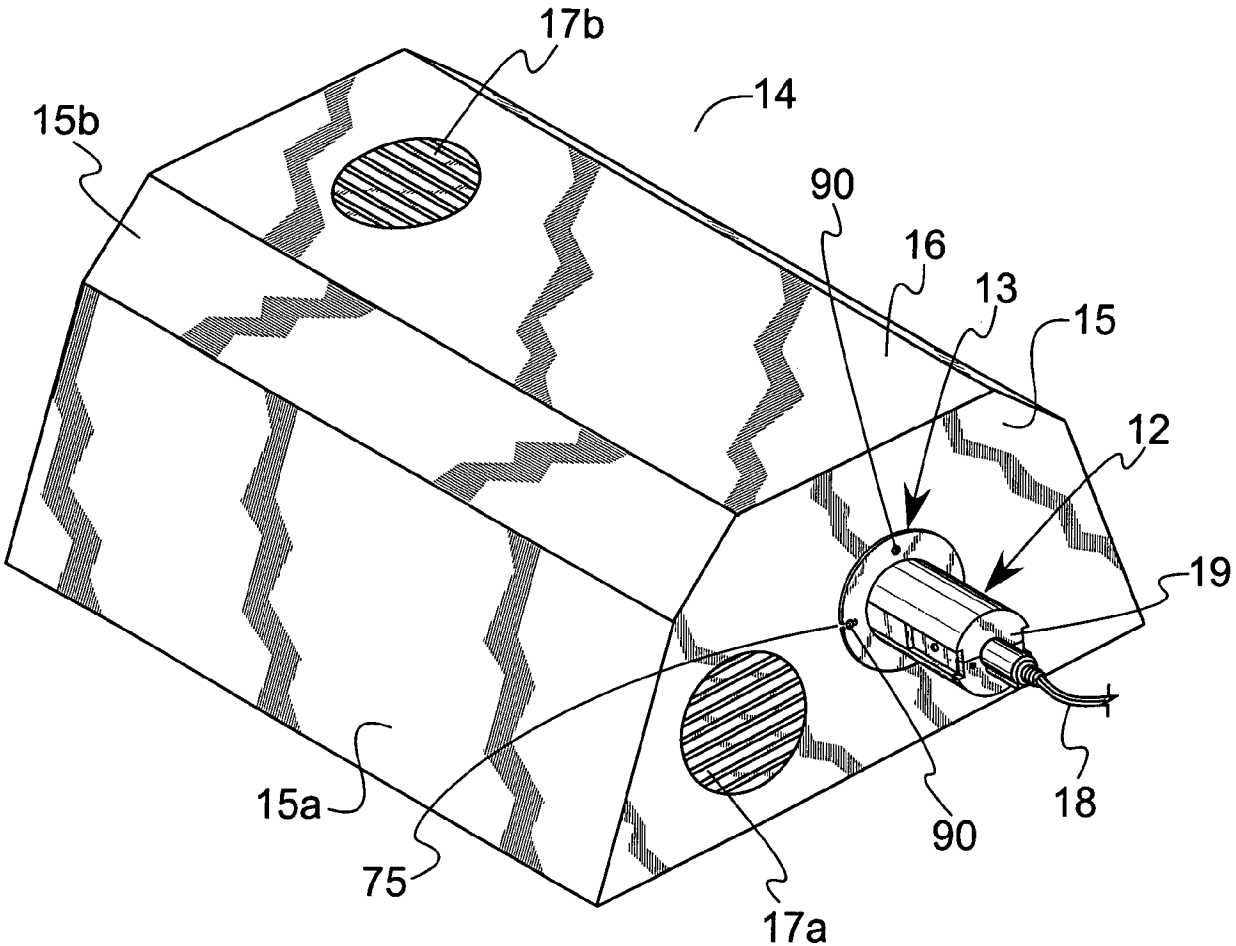
FIG. 10 is a perspective view of the reflector socket of the invention installed in an operative relationship in a lighting reflector.

Having reference to the drawings, attention is directed first to FIG. 1 which discloses an adjustable reflector socket designated generally by the numeral 10, made in accordance with the present invention. From a comparison of FIGS. 1 and 10, it will be appreciated that the preferred embodiment of the reflector socket 10 includes as its major components a bulb socket 11, a mounting member 12, and a mounting plate 13. The bulb socket itself is of the type currently well known in the art, the invention residing in the reflector socket as a whole, and the method of attaching it to a lighting reflector 14, the reflector also being of the type well known in the art.

Although there are a variety of lighting reflectors 14 on the market, most include a sidewall 15, a top surface 16, and often at least one or two air vents 17*a* and 17*b* respectively. Even with respect to the sidewall 15, it may be present in side sections such as 15*a* and 15*b* respectively, or it may be what some would refer to as an end wall, such as the one to which the reflector socket is shown as being secured. In actual use, the reflector socket 10 is secured to the lighting reflector 14 such that the electrical cord 18 extends to a ballast (not shown) of the type which is also well known in the trade. The electrical cord 18 passes through a connector 19 as it enters the interior of the reflector socket 10 where it is ultimately connected to the wiring of the socket in the manner well known in the art.

Returning now to a discussion of the preferred embodiment of the invention, it will be appreciated from a comparison of FIGS. 1–9, that the mounting member 12 has an exterior sidewall 21 which effectively has a sidewall first section 21*a* and a sidewall second section 21*b*. While the mounting member 12 is shown in the drawings as being generally cylindrical, other configurations could be chosen. Nevertheless, the mounting member 12 has formed in the exterior sidewall 21 at least one groove 22, and preferably two, such that where there are two grooves they are on opposite sides of the mounting member and preferably in the same plane. Each groove 22 has a groove bottom surface 24 with at least one, and preferably more than one, and in the preferred embodiment of the invention four groove apertures 25. Each groove 22 has a pair of groove side surfaces 26 and a groove top edge 28 immediately adjacent the exterior sidewall surface 21.

The mounting member 12 can be appreciated as having a first end 34 and a second end 32, with the second end being directly adjacent the socket 11. Meanwhile, the first end 34 features the end wall 40 of the mounting member, as well as detachable end plate 50, with gasket 35 being positioned between the end plate 50 and the first end 34. The gasket may be rubber or other material which assists in providing a moisture barrier, since the locations where these products would be typically used is often humid.

In the embodiment shown in FIG. 1 the end wall 40 has at least one end wall groove sidewall 42 on opposite sides of the mounting member, such that two are shown in FIG. 1. The end wall 40 also has an end wall groove edge 43 directly adjacent the end wall groove sidewall, with two end wall groove edges also being shown in FIG. 1. The mounting member end wall 40 also has an end wall inside edge 44, of which two such edges are shown in FIG. 1, and an end wall aperture sidewall 45. It can be appreciated that the end wall inside edge 44 has its opposite ends connected to the end wall groove sidewall and the end wall aperture sidewall respectively.

As mentioned above, the first end of the mounting member also has an end plate 50, which preferably is detachable in case any of the electrical circuitry contained in the interior of the mounting member 12 requires service. The end plate 50 is disclosed as having a peripheral sidewall edge 51, at least one and preferably two end plate groove sidewalls 52 with each end plate groove sidewall connected to a respective peripheral sidewall edge. Each end plate also has an end plate groove bottom 53 shown as being directly adjacent each end plate groove sidewall. Similar to the end wall 40, the end plate 50 has an end plate inside edge 54, and an end plate aperture sidewall 56. The end plate inside edge has its opposite ends connected to the end plate aperture groove sidewall and the end plate groove bottom. The end plate also has an end plate aperture groove sidewall 56, with two being shown in FIG. 1, and an end plate aperture groove bottom 57. The cord 18, and preferably the connector 19 pass through the aperture formed by the cooperative relationship between the end wall and the end plate, such that the circuitry is connected to the wiring (not shown) of the socket in the manner well known in the art, with this connection taking place within the mounting member in the mounting member interior 59. The end plate has at least one and preferably two end plate apertures 58 which fasteners 90, such as but not limited to metal screws, pass through to secure the end plate to the mounting member in a conventional manner with cooperative fastening apertures of the type well known in the art being provided in the mounting member interior 59.

Turning now to the socket 11, it has an exterior surface 60, a socket first end 62 which is directly adjacent the socket end wall 63, and a socket second end 64. The socket 11 is secured to the mounting member 12 at the end wall 63 in a manner well known in the art. As can be particularly appreciated from FIG. 3, the electrical connections 65 although not shown per se are of the type which is well known in the art of bulb sockets.

Turning now to the mounting plate 13, it is shown as having a first surface 71 and a second surface 72, with the second surface 72 being the one which is directly adjacent the reflector sidewall 15. Although the mounting plate is shown in a ring or disk-like shape, any number of geometric shapes could be used. It has an outer edge or peripheral edge 73*a* and an inner edge 73*b*.

The mounting plate also has at least one, preferably more than one, and in the embodiments shown in the drawing figures, three apertures to assist with the mounting of the mounting plate to the reflector. A first mounting aperture 74 is shown near the top of the mounting plate at approximately the vertical centerline. A mounting plate groove 75 is shown extending horizontally inwardly from the peripheral edge 73*a*. A second mounting aperture 76 is shown on the opposite side of the mounting plate from the mounting plate groove or slot 75. It is bigger across the bottom than at the top to permit a fastener 90 to be inserted through the lower portion of the aperture and secured such that the fastener is ultimately at the top of the second aperture. In actual use, a fastener may be secured to a reflector through the first mounting aperture, such that the mounting plate hangs downwardly thus permitting the slot 75 and second aperture 76 to be in the same generally horizontal plane. A second fastener is then secured to the reflector through the slot 75. Finally, another fastener is secured to the reflector at the second mounting aperture in the manner mentioned above.

The mounting plate also has at least one and preferably two mounting plate flanges 77 which are configured to slidably adapt to fit within the grooves 22. Each mounting plate flange 77 has at least one and preferably two mounting plate flange apertures 78. Additionally, the mounting plate flange has an exterior surface 79*a* and an interior surface 79*b*, as well as a flange end wall 80. Extending between the mounting plate flanges and the generally planar portion of the mounting plate which is ultimately secured against the reflector is a flange connecting portion 85, best appreciated from a comparison of FIGS. 2 and 9.

A modified embodiment of the invention is disclosed in FIGS. 11–18, with that modified embodiment disclosing an adjustable reflector socket designated generally by the numeral 100. From a comparison of FIGS. 11–18, it will be appreciated that the modified embodiment of the reflector socket 100 includes as its major components a mounting member 112 with end 114, a socket 116, and a mounting plate 118. Once again, the bulb socket itself is of the type currently well known in the art, the invention residing in the reflector socket as a whole, and the method of attaching it to a lighting reflector in the manner discussed with respect to the preferred embodiment.

The mounting member 112 has an exterior sidewall 120 which effectively has a sidewall first section 120*a* and a sidewall second section 120*b*. While the mounting member 112 is shown in the drawings as being generally cylindrical, other configurations could be chosen. Nevertheless, the mounting member 112 has formed in the exterior sidewall 120 at least one groove 122, and preferably two, such that where there are two grooves they are on opposite sides of the mounting member and preferably in the same plane. Each groove 122 has a groove bottom surface 124 with at least one, and preferably more than one, and in the preferred embodiment of the invention four groove apertures 125. Each groove 122 has a pair of groove side surfaces 126 and a groove top edge 128 immediately adjacent the exterior sidewall surface 120.

The mounting member 112 can be appreciated as having a first end 134 and a second end 132, with the second end being directly adjacent the socket 116. Meanwhile, the first end 134 features the end wall 140 of the mounting member, as well as detachable end plate 150, with gasket 135 being positioned between the end plate 150 and the first end 134. The gasket may be rubber or other material which assists in providing a moisture barrier, since the locations where these products would be typically used is often humid.

Figure 11:
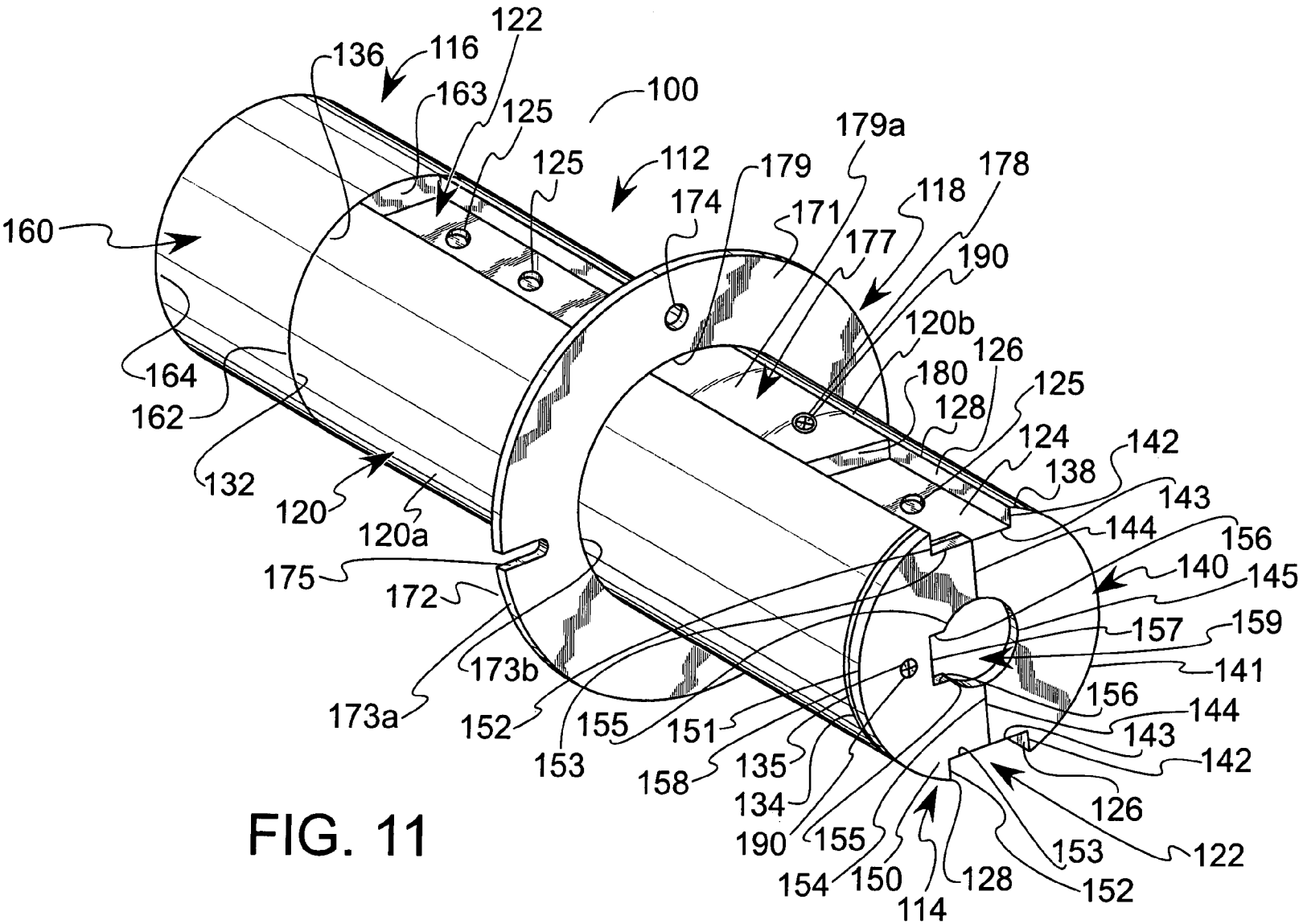
FIG. 11 is a perspective view of a reflector light socket made in accordance with a modified embodiment of the present invention.
Figure 12:
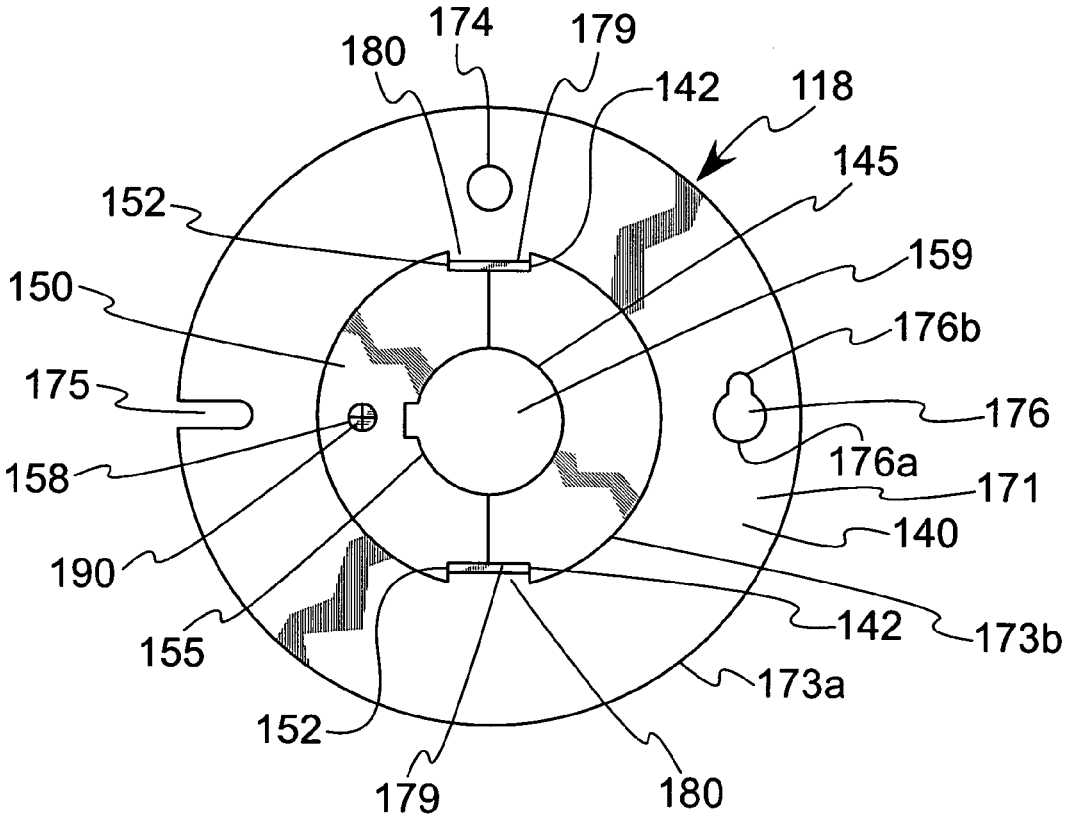
FIG. 12 is a front elevational view taken from the right side of FIG. 11.
Figure 13:
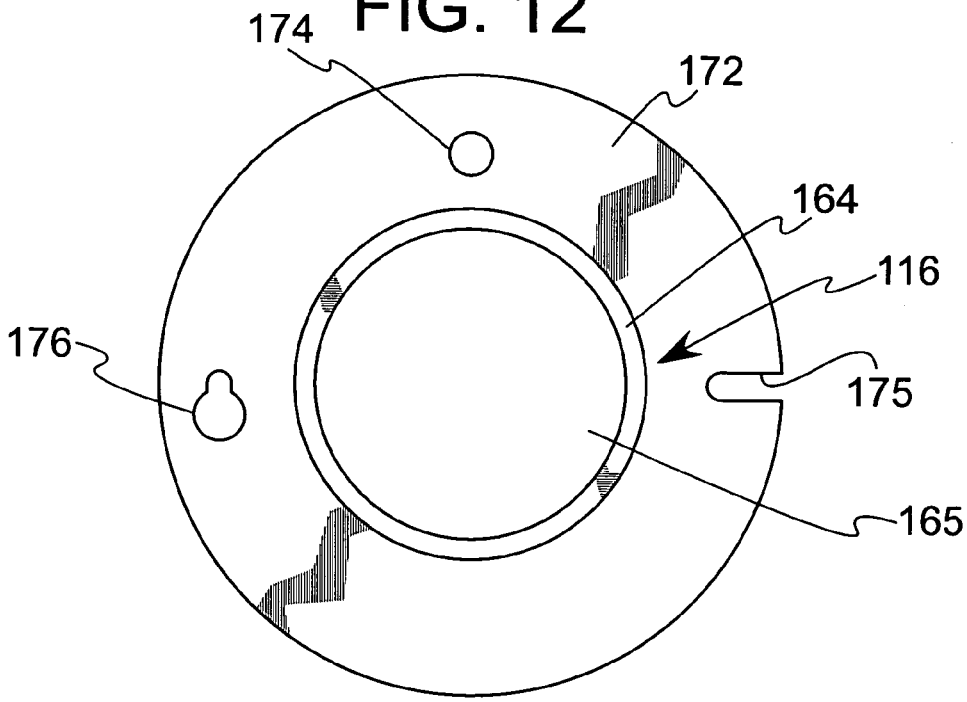
FIG. 13 is a rear elevational view taken from the left side of FIG. 11.
Figure 14:
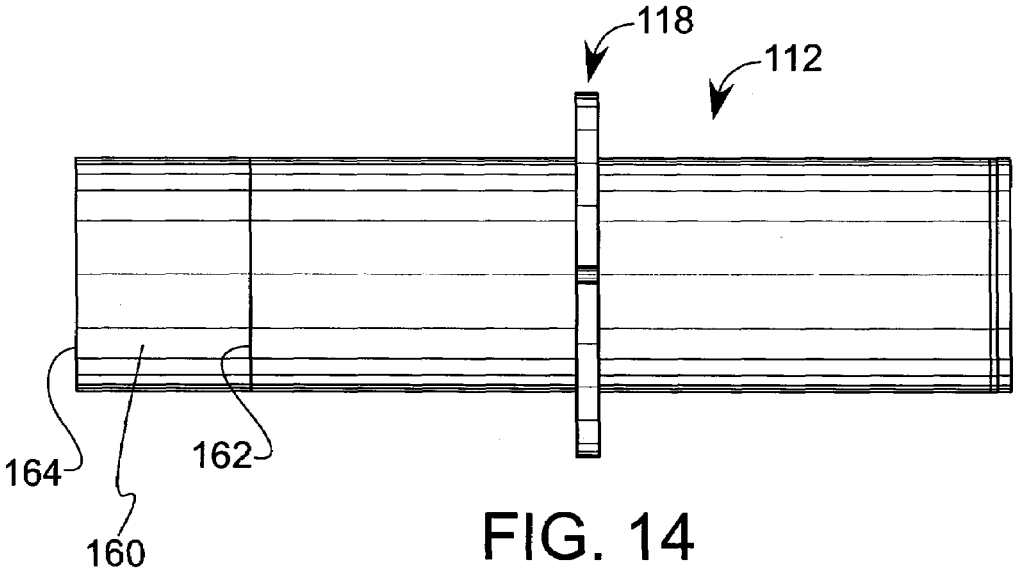
FIG. 14 is a left side elevational view of the modified embodiment.
Figure 15:
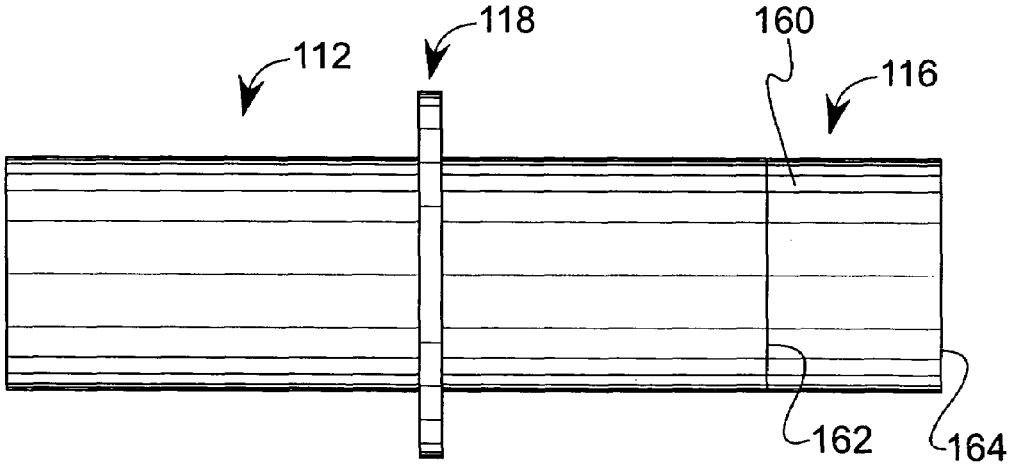
FIG. 15 is a right side elevational view of the modified embodiment.
Figure 16:
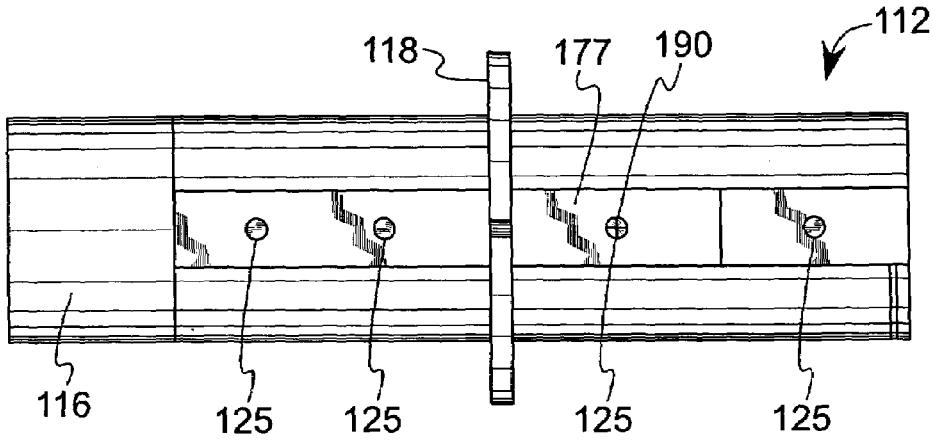
FIG. 16 is a top plan view of the modified embodiment.
Figure 17:
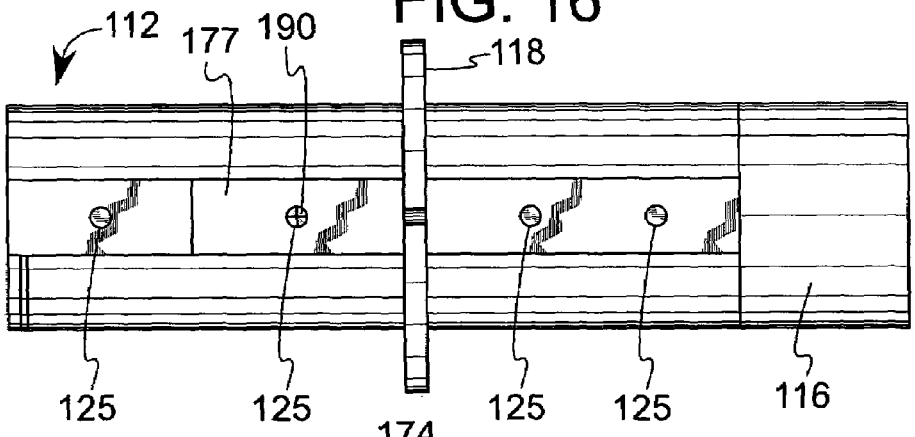
FIG. 17 is a bottom plan view of the modified embodiment.

The end wall 140 has at least one end wall groove sidewall 142, with two being shown in FIG. 11. The end wall 140 also has an end wall groove edge 143, with two being shown in FIG. 1. The mounting member end wall 140 also has an end wall inside edge 144, of which two such edges are shown in FIG. 1, and an end wall aperture sidewall 145.

As mentioned above, the first end of the mounting member also has an end plate 150, which preferably is detachable in case any of the electrical circuitry contained in the interior of the mounting member 112 requires service. The end plate 150 is disclosed as having a peripheral sidewall edge 151, at least one and preferably two end plate groove sidewalls 152, as well as an end plate groove bottom 153. Similar to the end wall, the end plate 150 has an end plate inside edge 154, and an end plate aperture sidewall 155. The end plate also has an end plate aperture groove sidewall 156, with two being shown in FIG. 11, and an end plate aperture groove bottom 157. The electrical cord used with the device and preferably its connector pass through the aperture formed by the cooperative relationship between the end wall and the end plate, such that the circuitry is connected to the wiring (not shown) of the socket in the manner well known in the art, with this connection taking place within the mounting member in the mounting member interior 159. The end plate has at least one and preferably two end plate apertures 158 which fasteners 190 pass through to secure the end plate to the mounting member in a conventional manner.

Turning now to the socket 116, it has an exterior surface 160, a socket first end 162 which is directly adjacent the socket end wall 163, and a socket second end 164. The socket 116 is secured to the mounting member 112 at the end wall 163 in a manner well known in the art. As can be particularly appreciated from FIG. 13, the electrical connections 165 although not shown per se are of the type which is well known in the art of bulb sockets.

Turning now to the mounting plate 118, it is shown as having a first surface 171 and a second surface 172, with the second surface 172 being the one which is directly adjacent the reflector sidewall. Although the mounting plate is shown in a ring or disk-like shape, any number of geometric shapes could be used. It has an outer edge or peripheral edge 173*a* and an inner edge 173*b*.

The mounting plate also has at least one, preferably more than one, and in the embodiments shown in the drawing figures, three apertures to assist with the mounting of the mounting plate to the reflector. A first mounting aperture 174 is shown near the top of the mounting plate at approximately the vertical centerline. A mounting plate groove 175 is shown extending horizontally inwardly from the peripheral edge 173*a*. A second mounting aperture 176 is shown on the opposite side of the mounting plate from the mounting plate groove or slot 175. It is bigger across the bottom than at the top to permit a fastener 190 to be inserted through the lower portion of the aperture and secured such that the fastener is at ultimately at the top of the second aperture. In actual use, a fastener may be secured to a reflector through the first mounting aperture, such that the mounting plate hangs downwardly thus permitting the slot 175 and second aperture 176 to be in the same generally horizontal plane. A second fastener is then secured to the reflector through the slot 175. Finally, another fastener is secured to the reflector at the second mounting aperture in the manner mentioned above.

Figure 19:
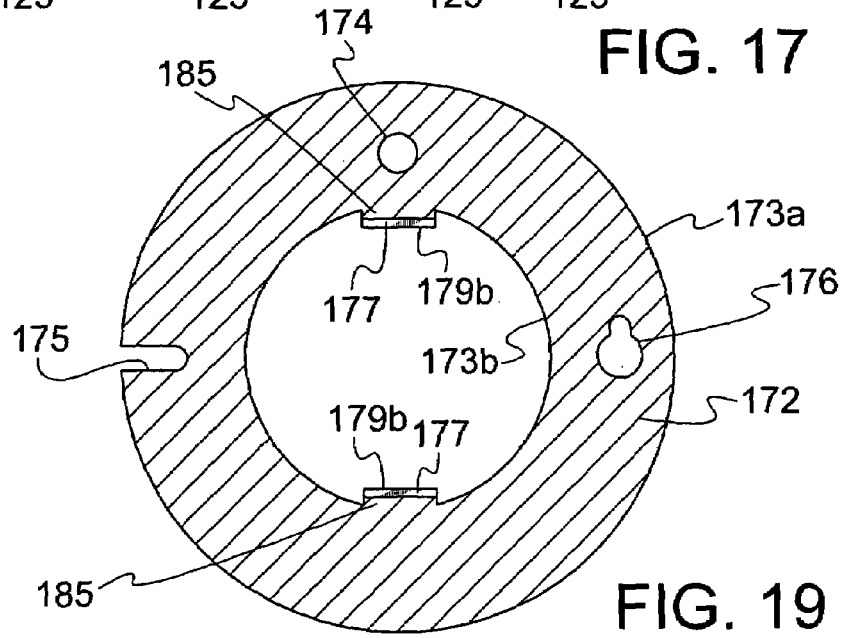
FIG. 19 is a vertical sectional view taken along line 19—19 of FIG. 18.
Figure 18:
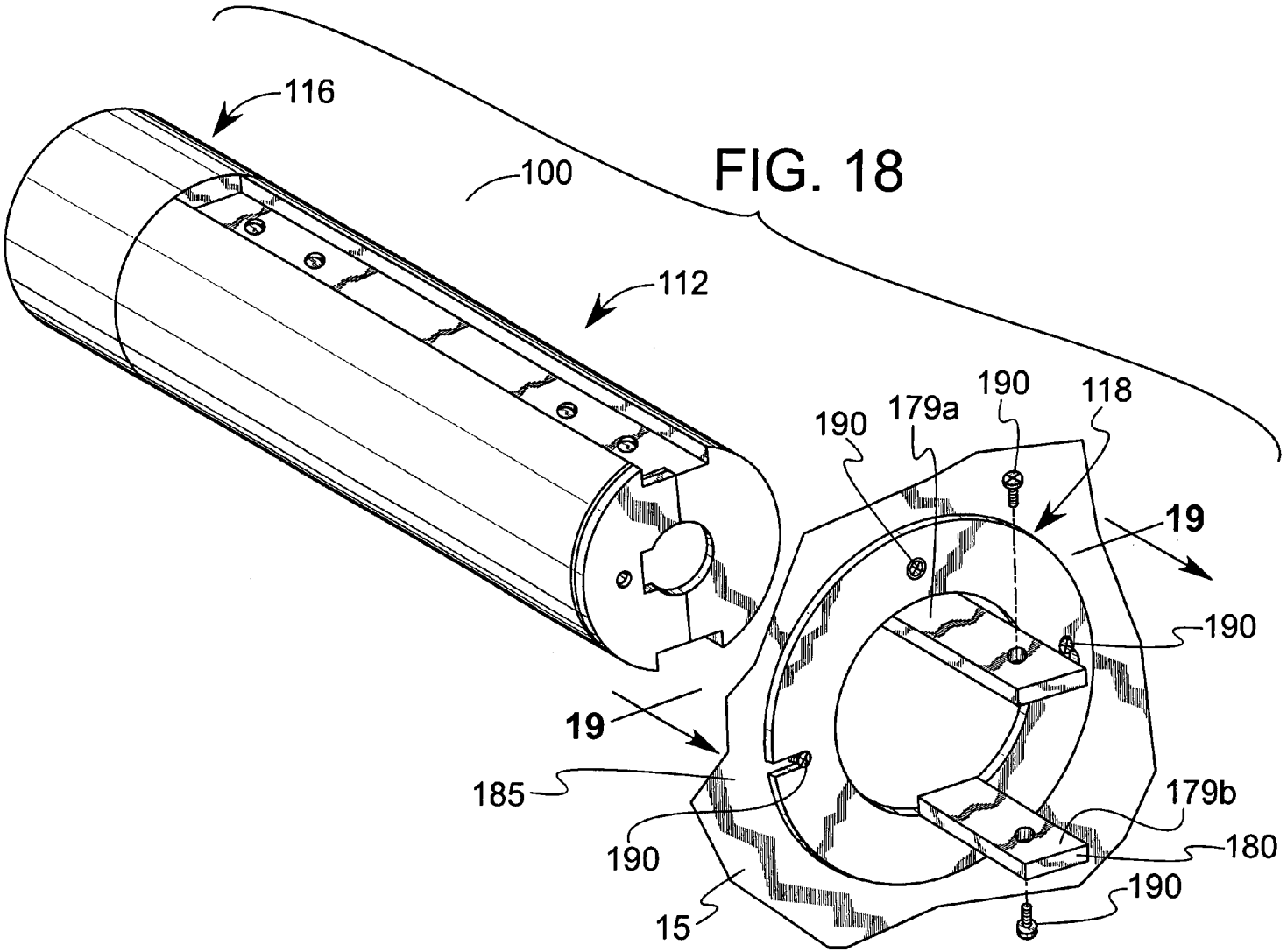
FIG. 18 is an exploded perspective view taken of the invention shown in FIG. 11.

The mounting plate also has at least one and preferably two mounting plate flanges 177 which are configured to slidably adapt to fit within the grooves 122. Each mounting plate flange 177 has at least one and preferably two mounting plate flange apertures 178. Additionally, the mounting plate flange has an exterior surface 179*a* and an interior surface 179*b*, as well as a flange end wall 180. Extending between the mounting plate flanges and the generally planar portion of the mounting plate which is ultimately secured against the reflector is a flange connecting portion 185, best appreciated from a comparison of FIGS. 12 and 19.

Figure 20:
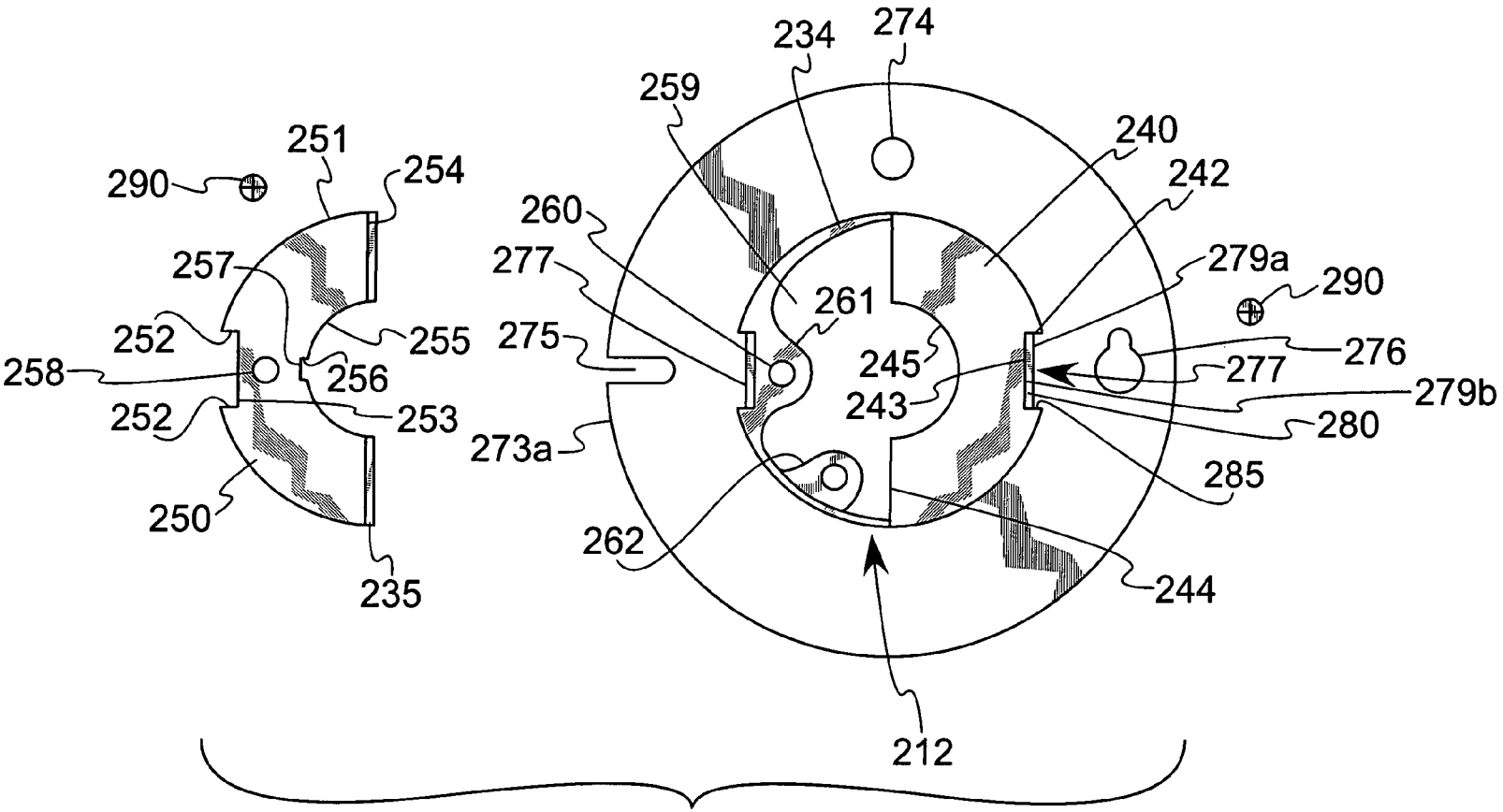
FIG. 20 is an exploded front elevational view similar to FIG. 2, but of a further modified embodiment of the invention.

FIG. 20 discloses yet another modified embodiment of the invention, with the differences being able to be appreciated from an exploded end view. In this embodiment, the mounting member first end 234 features an end wall 240 of the mounting member 212, as well as a detachable end plate 250.

A gasket 235 is positioned between the end plate 250 and the first end 234. The gasket is at least coextensive with the surface area of the end plate, and as shown can extend slightly beyond the end plate inside edge 254 so as to slide beneath that portion of the end wall 240 adjacent to the end wall inside edge 244. The gasket may be rubber or other material which assists in providing a moisture barrier, since the locations where these products would be typically used is often humid.

The end wall 240 has at least one end wall groove sidewall 242, with two being shown in FIG. 20. The end wall 240 also has an end wall groove edge 243. The mounting member end wall 240 also has an end wall inside edge 244, of which two such edges are shown in FIG. 20, and an end wall aperture sidewall 245.

This embodiment of the invention also has an end plate 250, which is detachable in case any of the electrical circuitry contained in the interior of the mounting member 212 requires service. The end plate 250 is disclosed as having a peripheral sidewall edge 251, at least one and preferably two end plate groove sidewalls 252, as well as an end plate groove bottom 253. Similar to the end wall 240, the end plate 250 has an end plate inside edge 254, and an end plate aperture sidewall 255. The end plate also has an end plate aperture groove sidewall 256, with two being shown in FIG. 20, and an end plate aperture groove bottom 257.

The electrical cord used with the device and preferably its connector pass through the aperture formed by the cooperative relationship between the end wall 240 and the end plate 250, such that the circuitry is connected to the wiring (not shown) of the socket in the manner well known in the art. In this embodiment, the detachable end plate 250 is shown having one end plate aperture 258 which fasteners 290 pass through to secure the end plate to the mounting member in a conventional manner, with this connection taking place within the mounting member at a cooperative fastening site 260 on an attachment tab 261 secured to or formed integral with the mounting member 212 at its first end 234 in the mounting member interior 259.

In this embodiment, a screw boss 262 is shown as part of the interior of the mounting member for purposes of grounding of the electrical circuitry if needed. The screw boss 262 is of the type well known in the art of electrical socket manufacture for growing lights and is set back from the first end of the mounting member to permit the ground wire to be secured to the screw boss without interfering with the detachable end plate. While only shown with respect to this particular embodiment, it should be understood that it could be incorporated into the other embodiments discussed above. The remainder of the embodiment shown in FIG. 20 is substantially similar to what has been described above with respect to the other embodiments, and one of ordinary skill in the art could readily fabricate the remainder of the invention associated with FIG. 20.

In discussing dimensions associated with a specific embodiment of the invention, it should be appreciated that in the preferred embodiment, the mounting cylinder is 4.625" long, with the four groove apertures being spaced 0.875", 1.70", 3.5", and 4.25" from the cylinder second end which is where the mounting cylinder attaches to the socket. The porcelain socket itself is of the type well known in the field of growing plants indoors. Further, the apertures in the mounting member flange are spaced 0.25" and 0.625" from the juncture of the mounting plate flange and the mounting plate first surface.

In actual use, it is possible to obtain the maximum emitted light from a bulb in the growing of plants through the use of a lighting reflector having an adjustable reflector light socket by the securing of the mounting plate to the sidewall of a lighting reflector, inserting the mounting member through the mounting member aperture in the mounting plate, with the mounting member having at least one groove formed therein and with a bulb socket being secured to one end of the mounting member. The mounting member is then secured to the mounting plate at a predetermined location on the mounting member dependant on the type of bulb and type of lighting reflector being used. The mounting plate has a centrally located mounting member aperture, with mounting member aperture configured to permit the mounting member to be inserted therethrough. The mounting plate also has at least one flange member extending generally perpendicularly from the juncture of the mounting plate and the mounting member aperture.

The flange member of the mounting plate is dimensioned to be slidably adapted in the mounting member groove, with the flange member having formed therein a plurality of flange apertures, and with the groove having formed therein a plurality of groove apertures, such that the method of using the device of the invention includes the additional step of selecting the flange aperture and groove aperture for attachment thereat of a flange fastener, so that the flange fastener secures the flange member to the mounting member at a location to maximize the emitted light given the choice of the bulb and the lighting reflector.

For example, if the four apertures in the mounting member are designated 1, 2, 3, and 4 respectively, with 1 being closest to the socket and 4 being closest to the cylinder first end, and if the two apertures in the mounting plate flange are designated A and B respectively, with A being closest to the mounting plate first surface, then with respect to the following lighting reflectors, the following predetermined combination of apertures can be used to obtain maximum emitted light depending on the type of bulb used. Of course it should be realized that these positions, reflector type, and bulb type are the current ones, and that the positions may well change if other reflectors or other bulbs are utilized. With the GLX Reflector, the positions for the following bulbs are as follows: MH1000 2 and B; HPS1000 1 and B; T30 1 and B; HPS600 2 and A; HPS430 2 and A; HPS400 2 and B; and Philips430 2 and A. With the Radiant Reflector, the positions for the following bulbs are as follows: MH1000 3 and B; HPS1000 1 and A; T30 1 and A; HPS600 3 and B; HPS430 3 and B; HPS400 3 and A; and Philips430 4 and B. With the Pro Reflector, the positions for the following bulbs are as follows: MH1000 4 and B; HPS1000 2 and A; T30 2 and A; HPS600 3 and B; HPS430 3 and A; HPS400 3 and A; and Philips430 4 and B. With the Super Grow Wing Reflector, the positions for the following bulbs are as follows: MH1000 2 and A; HPS1000 1 and B; T30 1 and B; HPS600 2 and A; HPS430 2 and A; HPS400 3 and B; and Philips430 3 and B.

As a result of the characteristics of the structure of the invention, an adjustable reflector socket is provided which can maximize the emitted light from a bulb in a particular lighting reflector. This is due in part to the cooperation between the mounting member and mounting plate, and more particularly due to the options provided through the incorporation of a plurality of apertures in the mounting member and the mounting plate flange in the preferred embodiment of the invention.

The reflector light socket of this invention is adjustable with respect to the reflector with which it is used, such that it can be used in conjunction with a variety of light bulbs to provide a highly effective level of light. Another benefit of the invention is that it results in a reflector light socket which is easily adjustable. Still another benefit is the providing of a unique mounting disc which can easily be secured to a lighting reflector, and which provides for the easy securing thereto of the desired socket means. Finally, the reflector light socket of this invention is relatively simple to manufacture.

While the form of apparatus and method herein described constitutes a preferred embodiment of this invention, it is to be understood that the invention is not limited to this precise form of apparatus and that changes may be made therein without departing from the scope of the invention which is defined in the appended claims.

What is claimed is:

1. An adjustable reflector socket for use in conjunction with a lighting reflector and light bulb, said socket comprising a bulb socket, a mounting member, said mounting member having an exterior sidewall, a first end and a second end, said first end having an end plate, said second end being adjacent to said bulb socket, said sidewall having at least one groove formed therein, said sidewall groove having a plurality of apertures formed therein, and a mounting plate, said mounting plate having a planar component, said planar component having at least one mounting aperture through which a mounting fastener passes to attach said mounting plate to the lighting reflector, and a centrally located mounting member aperture, said mounting member aperture configured to permit said mounting member to be inserted therethrough, said mounting plate also having at least one flange member, said flange member extending generally perpendicularly from the juncture of said mounting plate and said mounting member aperture, said flange member dimensioned to be slidably adapted in said sidewall groove, said flange member having formed therein at least one flange aperture, a flange fastener at said flange aperture securing said flange member to said mounting member at one of said apertures formed in said groove of said mounting member.

2. The adjustable reflector socket according to claim 1 wherein at least a portion of said end plate is detachable from said mounting member.

3. The adjustable reflector socket according to claim 1 wherein said mounting member comprises a pair of grooves.

4. The adjustable reflector socket according to claim 3 wherein each of said grooves is located on opposite sides of said mounting member.

5. The adjustable reflector socket according to claim 3 wherein said mounting plate comprises two flanges, each of said flanges being engaged in said grooves.

6. The adjustable reflector socket according to claim 5 wherein said flanges are located on opposite sides of said mounting plate.

7. The adjustable reflector socket according to claim 1 wherein said flange has more than one flange aperture formed therein.

8. The adjustable reflector socket according to claim 5 wherein each of said flanges has more than one flange aperture formed therein.

9. The adjustable reflector socket according to claim 1 wherein said groove extends from said first end to said second end of said mounting member.

10. The adjustable reflector socket according to claim 1 wherein said mounting plate comprises a mounting aperture in the same plane as said groove, and another mounting aperture in the form of a slot, said mounting plate having a peripheral edge, said slot extending centrally from said peripheral edge.

11. The adjustable reflector socket according to claim 1 wherein said groove has a width and a depth and said flange has a width and a thickness, said groove width being greater than said flange width, and said groove depth being approximately the same as said flange width.

12. The adjustable reflector socket according to claim 1 wherein said groove has four apertures formed therein, and said flange has two apertures formed therein.

13. The adjustable reflector socket according to claim 5 wherein each groove has four apertures formed therein and each flange has two apertures formed therein.

14. The method for obtaining the maximum emitted light from a bulb through the use of a lighting reflector having an adjustable reflector light socket comprising the steps of:

securing a mounting plate to the sidewall of a lighting reflector, said mounting plate having a centrally located mounting member aperture, said mounting member aperture configured to permit said mounting member to be inserted therethrough, said mounting plate also having at least one flange member, said flange member extending generally perpendicularly from the juncture of said mounting plate and said mounting member aperture, inserting a mounting member through said mounting member aperture in said mounting plate, said mounting member having at least one groove formed therein with a bulb socket being secured to one end of said mounting member, and securing said mounting member to said mounting plate at a predetermined location on said mounting member dependant on the type of bulb and type of lighting reflector being used.

15. The method according to claim 14 wherein said flange member is dimensioned to be slidably adapted in said mounting member groove, said flange member having formed therein a plurality of flange apertures, said groove having formed therein a plurality of groove apertures, said method including the additional step of selecting the flange aperture and groove aperture for attachment thereat of a flange fastener, said flange fastener securing said flange member to said mounting member at a location to maximize the emitted light given the choice of the bulb and the lighting reflector.

* * * * *